United States Patent [19]

Himi

[11] Patent Number: 4,919,075

[45] Date of Patent: Apr. 24, 1990

[54] ICE SLICER WITH SYRUP SUPPLY MECHANISM

[75] Inventor: Kohei Himi, Kuwana, Japan

[73] Assignee: Chubu Industries, Inc., Kuwana, Japan

[21] Appl. No.: 301,912

[22] Filed: Jan. 25, 1989

[30] Foreign Application Priority Data

Feb. 8, 1988 [JP] Japan ..... 63-15402

[51] Int. Cl.[5] ..... B05C 5/00

[52] U.S. Cl. ..... 118/699; 118/15; 241/101.2; 222/57; 222/135; 222/146.6; 425/104; 425/155; 425/306

[58] Field of Search ..... 222/57, 135, 146.6, 222/57, 135, 146.6, 146.1, 185; 83/403; 425/104, 306; 118/15, 699; 241/101 R, 25, 101.2

[56] References Cited

U.S. PATENT DOCUMENTS

| | | | |
|---|---|---|---|
| 3,145,878 | 8/1964 | Bert | 222/146.5 |
| 3,196,625 | 7/1965 | Nicolaus | 222/146.5 |
| 3,211,338 | 10/1965 | Weil et al. | 222/146.5 |
| 4,049,161 | 9/1977 | Kohl | 222/146.6 |
| 4,055,099 | 10/1977 | Mitsubayashi | 83/403 |
| 4,123,918 | 11/1978 | Kohl et al. | 222/146.6 |
| 4,417,671 | 11/1983 | Kawasaki et al. | 222/56 |
| 4,767,068 | 8/1988 | Ando | 83/403 |

*Primary Examiner*—Willard Hoag

*Attorney, Agent, or Firm*—Fulbright & Jaworski

[57] ABSTRACT

In an ice slicer with syrup supply mechanism, a frame is mounted on a base, a cutter case accommodating a rotary blade is mounted to the frame, a slit is formed in the cutter case, a cutting blade is so mounted as to be exposed to the slit, a syrup discharge nozzle is provided at the front of the frame, a connecting tube connects the discharge nozzle to a syrup container, and an electromagnetic valve is provided in the connecting tube. The electromagnetic valve is opened or closed by manipulating an operation switch provided on the frame.

2 Claims, 4 Drawing Sheets

ICE SLICER WITH SYRUP SUPPLY MECHANISM

BACKGROUND OF THE INVENTION

1. Field of the Invention

This invention relates to an ice slicer with a mechanism adapted to pour or spray syrup on shaved ice or ice shavings produced by slicing cubic ice blocks.

2. Description of the Prior Art

In the past, ice slicers have been known and an ice slicer disclosed in U.S. Pat. No. 4,055,099 is generally described herein as comprising a frame mounted on a base, a cutter case mounted to the frame and accommodating a rotary blade (rotor) which is driven for rotation by a motor, and a cutting blade so mounted as to be exposed to a slit formed in the cutter case.

With the prior art ice slicer, in order to pour or spray syrup on ice shavings heaped up in a cup, the syrup is dipped out of a separately installed syrup container by using a ladle and is sprayed or the syrup is discharged form a separate syrup container with a cock at the bottom by opening the cock and is srayed. Disadvantageously, before spraying, the cup with ice shavings heaped up therein must be pulled out of the ice slicer by hand and moved to a position where the syrup is poured, resulting in troublesome work.

Further, the user measures the amount of syrup to be sprayed by eye and the amount of sprayed syrup is slightly different for every service and can not be constant.

SUMMARY OF THE INVENTION

This invention contemplates elimination of the above prior art disadvantages and has for its object to provide an ice slicer capable of facilitating work of spraying syrup on ice shavings.

According to the invention, to accomplish the above object, in an ice slicer of the known type, at least one downward syrup discharge nozzle is provided at the front of the frame, the discharge nozzle is connected to a syrup container by a connecting tube, and an electromagnetic valve provided in the connecting tube is controlled by a control means. Thus, ice shavings produced by slicing ice blocks by means of the cutting blade are received in a cup placed at the front of the frame as in the case of the prior art ice slicer, the cup is moved horizontally at the front of the frame so as to be positioned beneath the syrup discharge nozzle, and the electromagnetic valve is opened under the control of the control means to automatically pour or spray syrup on ice shavings, whereby ice shavings sprayed with syrup can be produced without resort to such a troublesome operation of removing the cup from the ice slicer by hand as required in the prior art ice slicer.

Another object of this invention is to provide an ice slicer which can facilitate operation of spraying desired one of a plurality of kinds of syrup on ice shavings.

This object can be accomplished by an embodiment of the invention wherein a plurality of sets of syrup supply means are provided having each a syrup discharge nozzle, a connecting tube for connecting the nozzle to a syrup container, an electromagnetic valve provided in the connecting tube, and a control means for controlling the electromagnetic valve. Thus, a cup with ice shavings is moved to a position beneath a nozzle for supply of the desired kind of syrup, and the control means of the corresponding set is activated to open the corresponding electromagnetic valve.

Still another object of this invention is to provide an ice slicer which can measure, automatically and quantitatively, a constant amount of syrup to be sprayed and spray syrup by the constant amount on ice shavings independently of user's manual operation.

This object can be accomplished by another embodiment of the invention wherein a timer for desirably setting open time of the electromagnetic valve is provided in a control circuit for the control means. Thus, the timer is set to a short time setting in order to effect spray of a small amount of syrup and conversely the timer is set to a long time setting in order to effect spray of a large amount of syrup, thereby ensuring quantitative adjustment of the constant amount of syrup.

DESCRIPTION OF THE PREFERRED EMBODIMENT

Figure 3:
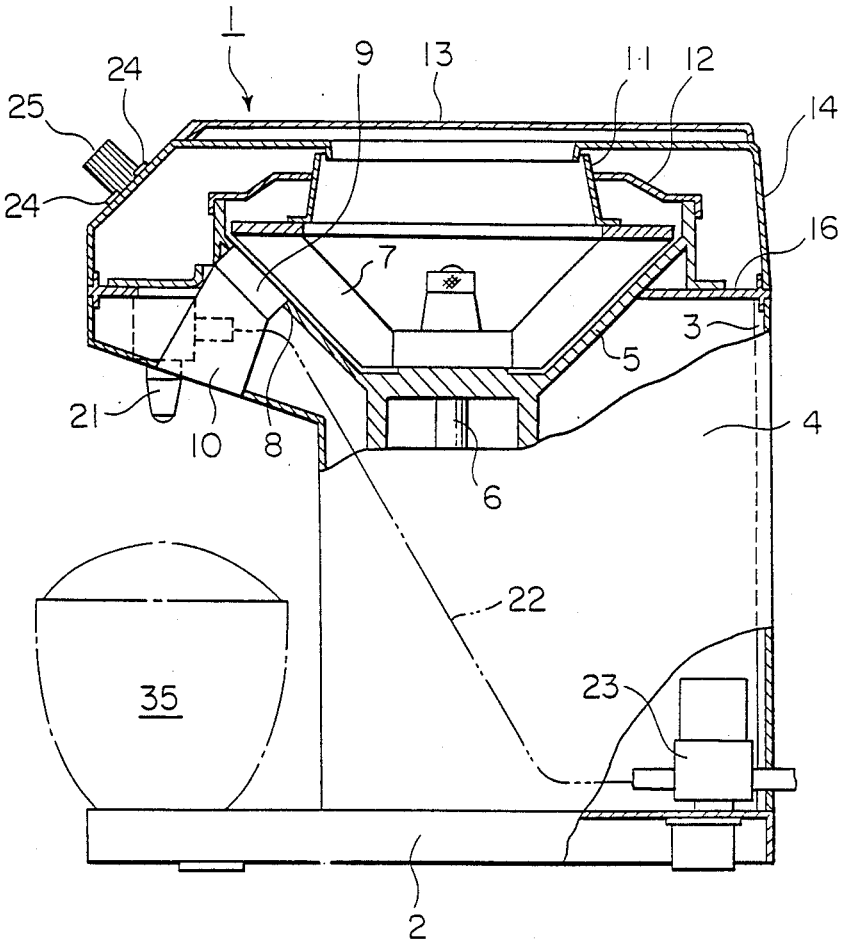
FIG. 3 is a side view, partly exploded, of the embodiment.

Referring particularly to FIG. 3, a plurality of struts 3 stand uprightly on a base 2 of an ice slicer 1 to support a frame 4, thereby forming a slicer body. Disposed on the slicer body is a support wall 16 having a circular opening in which an inverted-conical portion of a cutter case 5 fixedly mounted on the support wall 16 is inserted. Disposed below the bottom of the cutter case 5 is a motor 18 (FIG. 4) which is mounted on the base 2. A driving shaft 6 driven by the motor is rotatably supported by the cutter case 5 to project thereinto and a rotary blade (rotor) 7 having 3 to 4 blades spaced apart from the inclined surface of the case 5 is fixed on the driving shaft 6 by means of a nut so as to be rotated as the shaft 6 rotates.

A front portion of the cutter case 5 is formed with a slit 8 to which a cutting blade 9 is exposed and a chute 10 attached to a front portion of frame 4 or front cover surrounds the peripheral edge of the slit 8. A hopper 11 is fixedly mounted on the rotor 7, a water-proof cover 12 attached to the cutter case 5 surrounds the hopper 11, and an uppermost head cover 4 with an openable lid 13 is mounted to the slicer body to cover the hopper 11 and water-proof cover 12.

As will be seen from the above, the ice slicer structurally resembles the previously-described known ice slicer, with the exception that the width of the frame 4, as viewed from the front, is slightly increased and a plurality of (four in this embodiment) nozzles 21-1 to 21-4 are disposed at the front portion of frame 4 with their tip ends projecting downwards from the front cover. These nozzles 21-1 to 21-4 are respectively connected to syrup containers, not shown, by tubes 22-1 to 22-4 through electromagnetic valves 23-1 to 23-4 respectively located midway between each of the nozzles 21-1 to 21-4 and each of the syrup containers. As the syrup container, a commercially sold, pneumatically pressurized syrup container may be used. Individual syrup containers may contain different kinds of syrup.

Figure 1:
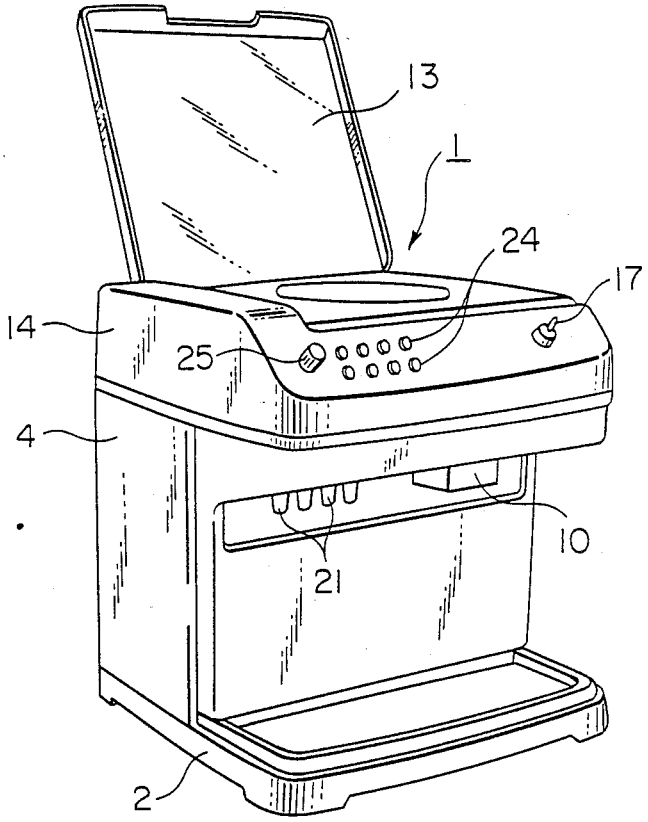
FIG. 1 is a perspective view illustrating an embodiment of an ice slicer according to the invention.
Figure 4:
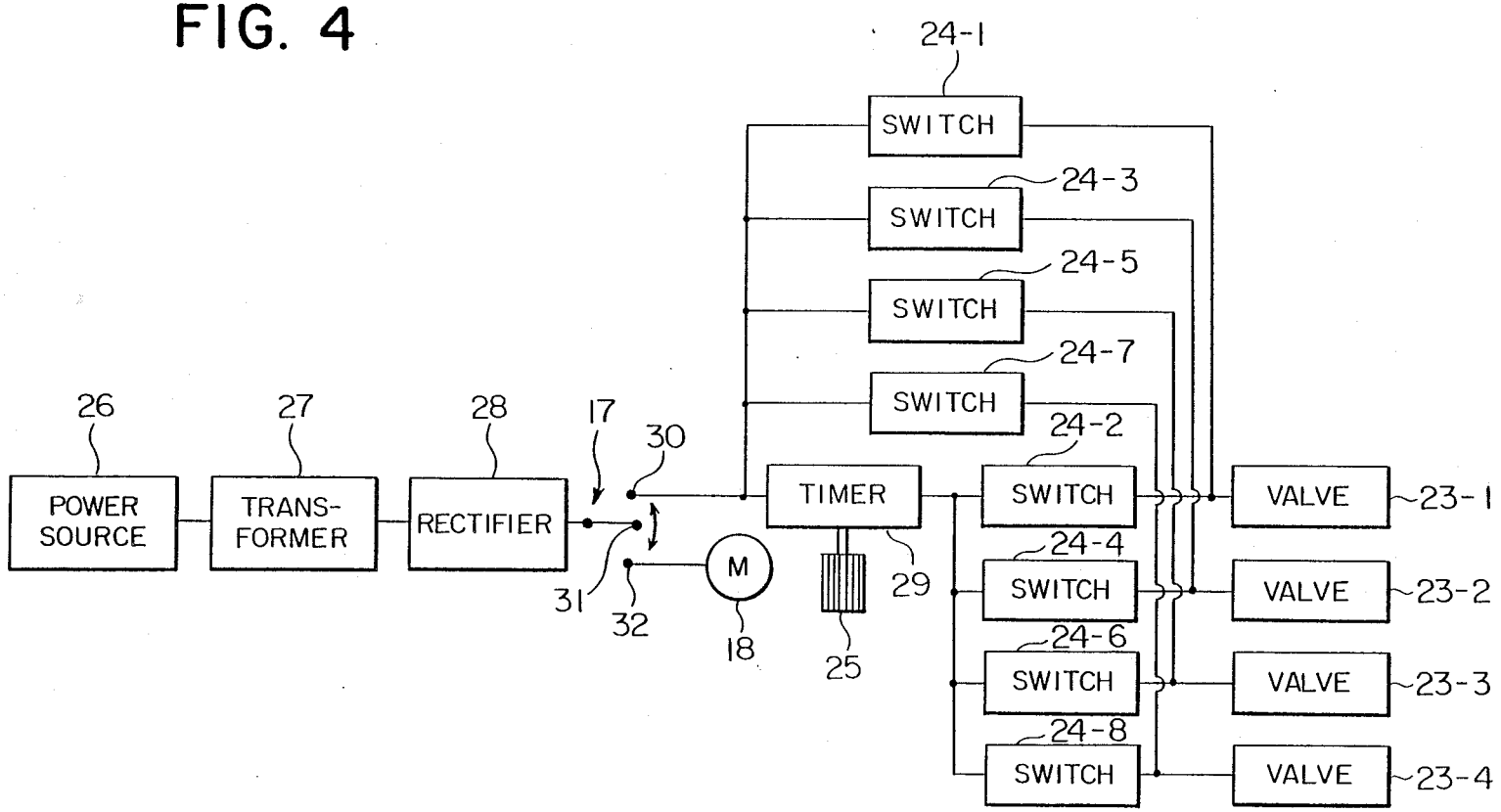
FIG. 4 is an electrical block diagram schematically illustrating a control circuit in the embodiment.

As best see in FIG. 1, a main switch 17 and operation switches 24-1 to 24-8 for open/close control of electromagnetic valves 23 are disposed on a front portion of the head cover 14 and the operation switches 24 are electrically interconnected to form a control circuit as shown in FIG. 4. Of switches 24, the switches 24-1 and 24-2 are used for controlling the electromagnetic valve 23-1, the switches 24-3 and 24-4 for the electromagnetic valve 23-2, the switches 24-5 and 24-6 for the electromagnetic valve 23-3, the switches 24-7 and 24-8 for the electromagnetic valve 23-4. These are also seen in FIG. 4 a power source 26, a transformer 27, a rectifier 28 and a timer 29 which can be operated by a knob 25 so as to be set to a desired time setting.

When slicing ice blocks with the ice slicer 1 constructed as above, the openable lid 13 of the ice slicer 1 is opened, a desired amount of cubic ice blocks are charged into the cutter case 5 by way of the hopper 11, the lid 13 is closed and the main switch 17 is transferred from neutral contact 31 to motor contact 32 to drive the motor 18 for ice slicing. With the motor 18 driven, the driving shaft 6 and the rotor 7 connected thereto are rotated to thereby cause the cubic ice blocks in the rotor 7 to rotate at high speeds along the inner surface of the cutter case 5.

Under the high-speed rotation, the cubic ice blocks are sliced or shaved by the cutting blade 9 having the cutting edge exposed to the slit 8 formed in the front portion of the ice slicer 1, and ice shavings are discharged through the discharge chute 10 and heaped up in a cup 35 which is located beneath the chute 10 at the front of the ice slicer.

Figure 2:
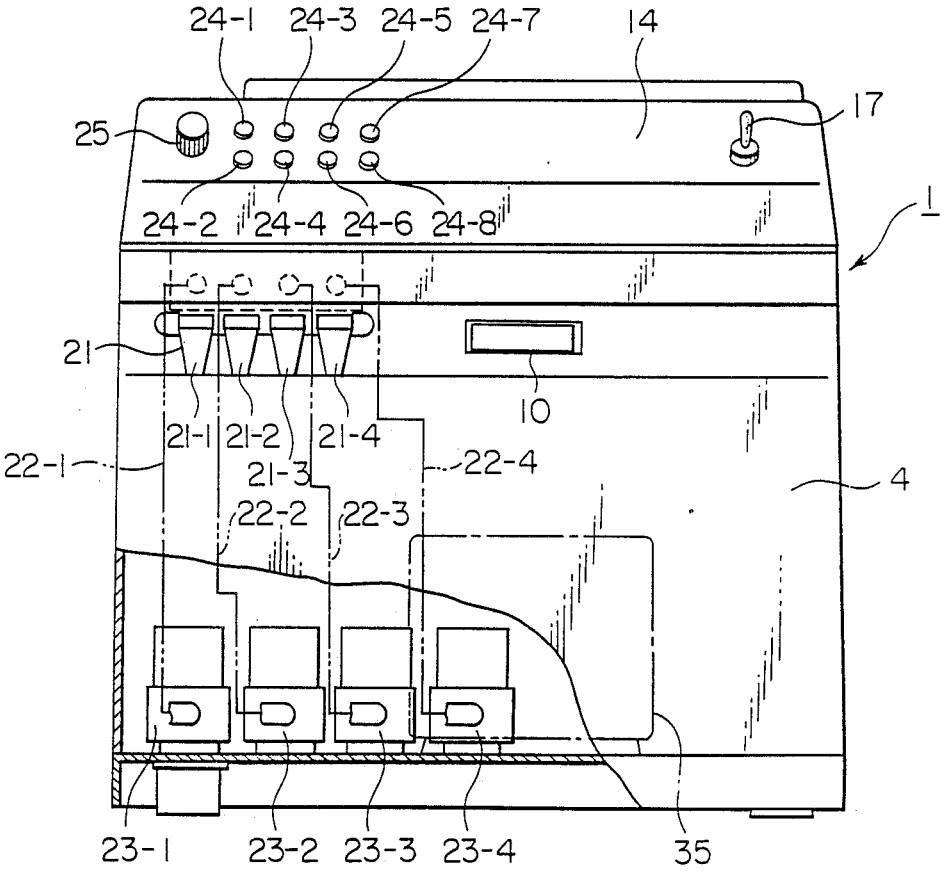
FIG. 2 is a front view, partly exploded, of the embodiment.

Then, the cup 35 with ice shavings heaped up therein is displaced to a position underlying desired one of the nozzles 21-1 to 21-4 which are arrayed on the lefthand side of the front of the ice slicer as best seen in FIG. 2 and the main switch 17 is transferred from motor contact 32 to control contact 30. Subsequently, one of the syrup supply operation switches 24-1, 24-3, 24-5 and 24-7, corresponding to or associated with the desired nozzle, is turned on by pushing so that corresponding one of the electromagnetic valves 23-1 to 23-4 can be energized to open. In response to opening of the electromagnetic valve 23, syrup contained in a syrup container connected with this electromagnetic valve 23 runs through one of the tubes 22-1 to 22-4 which is associated with the valve 23 of interest and is discharged through the desired nozzle so as to be poured or sprayed on the heaped-up ice shavings. Thereafter, the pushed switch 24 is turned off by releasing the finger from this switch to stop the syrup from discharging.

Accordingly, there is no need of manipulating a laddle to spray syrup on ice shavings heaped up in the cup 35 held in hand and all the user has to do is displace the position of the cup 35 slightly, transfer the main switch 17 and operate one of the operation switches 24-1, 24-3, 24-5 and 24-7.

It will be noted that the above operation is described by referring to a variable discharge-amount mode using the operation switches 24-1, 24-3, 24-5 and 24-7 wherein on-time of one of these operation switches can be controlled or changed manually to adjust the discharge amount. In another mode of quantitatively constant discharge amount using the operation switches 24-2, 24-4, 24-6 and 24-8, the timer 29 is set to a desired time setting by operating the knob 25 so that current conduction through one of the switches 24-2, 24-4, 24-6 and 24-8 which is once turned on by pushing may be controlled in accordance with the time setting and corresponding one of the electromagnetic valves 23-1 to 23-4 may be opened for corresponding duration of time, thereby making it possible to quantitatively pour syrup by a constant amount complying with the time setting of the timer 29.

In the foregoing embodiment, the pneumatically pressurized syrup container is used and a product of THE CORNELIUS COMPANY in Minnesota may preferably be used as this type of syrup container. But products of other companies may be employed and in place of the pneumatically pressurized container, a container having an outlet at the bottom may be used by being disposed above the ice slicer with turned upside down.

Further, the cutter case 5 with inverted-conical portion has been described for illustration purpose only and a cutter case of other types may also be used.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. An ice slicer with syrup supply mechanism comprising:

a frame mounted on a base;

a cutter case mounted to said frame and accommodating a rotor driven for rotation by a motor;

a cutting blade so mounted as to be exposed to a slit formed in said cutter case;

at least one downward syrup discharge nozzle provided at the front of said frame;

a connecting tube for connecting said discharge nozzle to a syrup container installed separately from said ice slicer;

an electromagnetic valve provided in said connecting tube; and control means, provided inside said frame, for controlling said electromagnetic valve, said control means including first and second electrical switches connected in parallel with each other and connected to said electromagnetic valve, said first switch being a manual off on switch providing a variable discharge amount mode of operation and said second switch being controlled by a settable timer providing a constant discharge amount mode of operation.

2. An ice slicer according to claim 1 wherein a plurality of sets of syrup supply means are provided having each a syrup discharge nozzle, a connecting tube for connecting said discharge nozzle to a syrup container, an electromagnetic valve provided in said connecting tube, and control means for controlling said electromagnetic valve, said control means for each set of syrup supply means including first and second electrical switches connected in parallel with each other and connected to said electromagnetic valve, said first switch being a manual off-on switch providing a variable discharge amount mode of operation and said second switch being controlled by a settable timer providing a constant discharge amount mode of operation.

* * * * *